US007950121B2

(12) United States Patent
Werner

(10) Patent No.: US 7,950,121 B2
(45) Date of Patent: May 31, 2011

(54) METHOD FOR ROUNDING THE EDGES OF PARTS

(75) Inventor: Klemens Werner, Munich (DE)

(73) Assignee: MTU Aero Engines GmbH, Munich (DE)

( * ) Notice: Subject to any disclaimer, the term of this patent is extended or adjusted under 35 U.S.C. 154(b) by 1194 days.

(21) Appl. No.: 10/554,612

(22) PCT Filed: Mar. 20, 2004

(86) PCT No.: PCT/DE2004/000581

§ 371 (c)(1),
(2), (4) Date: Nov. 3, 2006

(87) PCT Pub. No.: WO2004/096493

PCT Pub. Date: Nov. 11, 2004

(65) Prior Publication Data

US 2007/0050977 A1 Mar. 8, 2007

(30) Foreign Application Priority Data

Apr. 27, 2003 (DE) ..... 103 19 020

(51) Int. Cl.
*B24B 39/00* (2006.01)
*B21C 37/30* (2006.01)

(52) U.S. Cl. ..... 29/90.7; 29/889.6; 29/889.7; 451/38

(58) Field of Classification Search ..... 29/90.7, 29/889.22, 889.6, 889.7, 889.71; 451/3, 451/5, 38–40, 84, 88, 89, 100
See application file for complete search history.

(56) References Cited

U.S. PATENT DOCUMENTS 3,078,546 A 2/1963 Kiernan
5,558,562 A * 9/1996 Diat ..... 451/38
5,599,413 A * 2/1997 Nakao et al. ..... 156/89.12

FOREIGN PATENT DOCUMENTS

DE 197 20 756 9/1998
DE 697 12 613 11/2002

* cited by examiner

*Primary Examiner* — Thiem Phan
(74) *Attorney, Agent, or Firm* — Crowell & Moring LLP

(57) ABSTRACT

A method for rounding edges of parts, in particular of turbo engines, is disclosed. An edge to the surfaces is rounded, the edge being created by at least two adjacent surfaces of the part. A blasting jet consisting mostly of abrasive particles is directed at its center approximately tangentially to the angle bisecting line between the surfaces at the edge and is moved at a defined rate of advance in relation to the part along the edge such that there is a defined removal of material of the part with rounding toward the surfaces.

12 Claims, 2 Drawing Sheets

METHOD FOR ROUNDING THE EDGES OF PARTS

This application claims the priority of International Application No. PCT/DE2004/000581, filed Mar. 20, 2004, and German Patent Document No. 103 19 020.1, filed Apr. 27, 2003, the disclosures of which are expressly incorporated by reference herein.

BACKGROUND AND SUMMARY OF THE INVENTION

This invention relates to a method for rounding the edges of parts, in particular of turbo engines.

It may be necessary, for various reasons, to round the edges of parts, in particular on turbo engines. These include improving the strength and/or aerodynamics and preventing the risk of injury. Depending on the part, there may be sharp edges on parts that are to be rounded to the adjacent surfaces of the part. Alternatively, the edges may also form planar or three-dimensional surfaces which connect adjacent surfaces of the part, usually much larger surfaces. The latter case usually occurs with relatively coarsely prefabricated edges on hydromechanically active blades of turbo engines, in particular on the guide vanes and rotor blades of gas turbines, where the blade edges with the adjacent pressure side and/or suction side of the blades must be rounded for reasons of fatigue, strength and aerodynamics.

It is known that surfaces must be roughened by abrasive blasting before coating operations to clean the surfaces and improve adhesion to the layer. German Patent Document No. DE 697 12 613 T2 additionally discloses a method for honing cutting edges, whereby these edges are machined by abrasive fluid jets using the abrasiveness to introduce fine grooves into the surface.

German Patent Document No. DE 197 20 756 C1 discloses a method for surface treatment wherein the surface is subjected to a particle bombardment. This introduces compressive stresses into the material to increase the long-term strength and the tensile strength of the part in particular.

In the case of blade edges, which are generally premachined only relatively coarsely due to the manufacturing technique, rounding has so far been performed largely by manual labor, using hand-guided machines such as belt grinders, etc., if necessary. This is very labor-intensive and time-consuming and ultimately uniform, reproducible machining results cannot be guaranteed even with targeted control and testing.

In view of these known methods and their disadvantages and their limits in terms of applications, the object of the present invention is to provide a method for rounding edges, which permits a great savings of time and personnel and leads to reproducible results through machine operation, optionally automatable. These reproducible results should be of the highest possible quality, achievable in a satisfactory manner with the lowest possible reject rate.

It has surprisingly been found that by abrasive blasting, taking into account defined machining parameters and nozzle definitions, relatively accurate rounded surface geometries can be produced on sharp edges of parts or relatively coarsely premachined blade edges. The functional reliability of this method and its reproducibility have been confirmed in experiments.

In the inventive method, the blasting jet is adjusted with its center approximately tangential to the angle bisecting line on the edge between the (generally) two surfaces on which the rounding is to be performed. In the case of surfaces meeting in the form of a sharp edge, the position of the angle bisecting line is immediately obvious. In the case of surfaces that do not meet directly, e.g., are joined by an edge in the form of a planar or three-dimensional surface, such as the pressure side and the suction side of a coarsely prefabricated edge of the blade of a gas turbine, tangents are drawn to the two surfaces at such an edge and the angle bisecting line between the intersecting tangents is determined. In the latter case of an edge to be rounded, the edge adjoining the pressure side and suction sides of a blade, this angle bisecting line is tangent to the center line of the profile of the blade at the edge, i.e., at the stagnation point.

Relatively small particles with a size of 0 to 500 mesh, preferably 180 to 320 mesh, are used to reduce any remachining of the rounded edges. In this way, abrasion of material for rounding is created by this method and cracks and roughness on the surfaces are prevented.

To create a blasting jet having a defined geometry and energy with regard to cross section, shape, etc., the blasting jet is produced by a nozzle having a defined outlet diameter and a defined outlet angle.

To produce a uniform geometry along the edge, the relative movement between the nozzle and the part may preferably take place in a defined variable distance between the nozzle and the blade edge.

The distance is generally adjusted continuously in a suitable manner, in the case of large-area edges with a width that changes over their length.

The direction of the center of the blasting jet to the center line of the profile of the blade at the edge of the blade may be set at an angle $\beta$ and/or may be laterally offset in relation to the center line of the profile in the direction of the pressure side or suction side to create, for example, aerodynamically desirable contour symmetries on the edge to be rounded.

BRIEF DESCRIPTION OF THE DRAWINGS

This invention is explained in greater detail below on the basis of the drawings with reference to the exemplary embodiments.

DETAILED DESCRIPTION OF THE DRAWINGS

Figure 1:
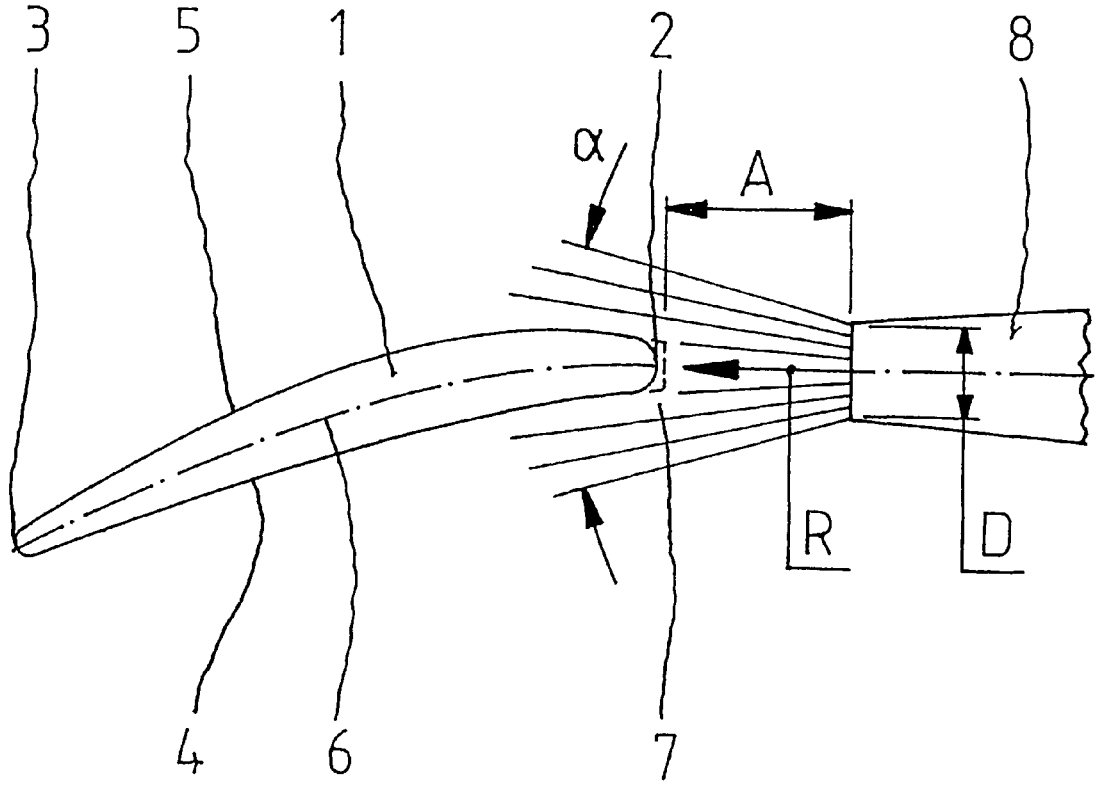
FIG. 1 shows in a simplified diagram, not drawn to scale, the machining of a leading edge of a blade.

The method for rounding edges is applicable with a wide variety of parts. Application cases include, in particular, all cases where sharp edges are to be rounded on parts to adjacent surfaces or impart a defined shape to the transition between adjacent surfaces in cases where prefabricated edges are to be rounded.

The method is described below on the basis of an edge on a hydromechanically-active blade of a gas turbine, whereby a relatively coarsely prefabricated blade edge is to be rounded to adjacent surfaces, in the present case the pressure side and/or suction side of the blade.

The blade 1 is to have a hydrodynamically advantageous shape in the completely machined state. This presupposes that the pressure side 4 and the suction side 5 of the blade profile correspond to the ideal contour as much as possible. This also presupposes that the blade edges 2, 3, i.e., the inlet edge and the outlet edge of the blade 1 connect the adjacent surfaces, i.e., the pressure side 4 and the suction side 5 in a hydrodynamically advantageous manner. In addition to the aerodynamic requirements, aspects involving strength and wear of the blade edges 2, 3 also play an important role. As a rule, the inlet and outlet edges of blades are designed with a definite rounding to meet all these requirements.

Blades having a relatively thin profile and relatively acute inlet and outlet edges, such as the compressor blades of axial compressors, are often manufactured by forging and/or cutting and/or electrochemical machining (ECM), where the blade edges are first designed only with a relatively coarse geometry, i.e., with planar faces, corners, bevels, etc. The large area pressure sides and suction sides 4, 5 often correspond to the ideal contour with a relatively high precision, so that only relatively little precision machining, if any at all, is required, with little or no removal of material. Thus, the prefabricated inlet and outlet edges are to be rounded by providing a transition from these edges to the pressure sides and suction sides 4, 5 without any kinks, steps or other interferences.

Figure 2:
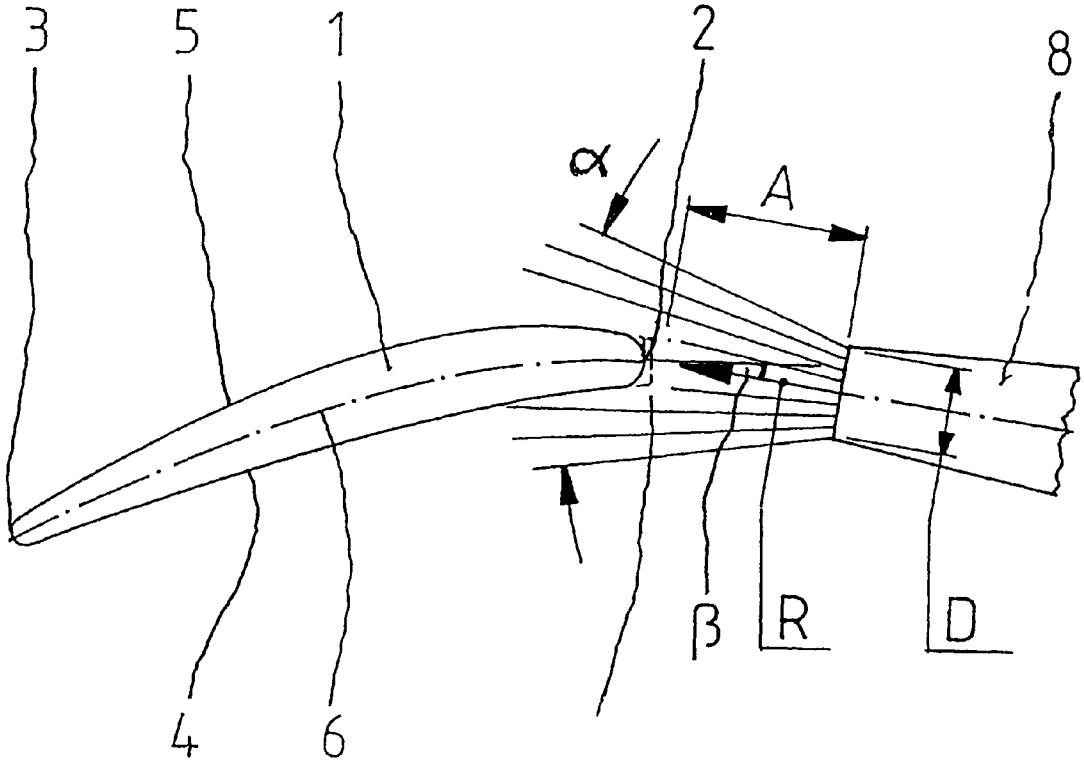
FIG. 2 shows a corresponding diagram like that in FIG. 1 illustrating an alternative exemplary embodiment for machining.

According to this invention, abrasive blasting is used as the machining method to accomplish this, with targeted removal of material from the blade. FIG. 1 shows a nozzle 8 of a blasting device, which is not shown in greater detail, with a blasting jet 7 emerging from the nozzle. This blasting jet consists of abrasive particles and a carrier gas and/or a carrier liquid. At least a considerable portion of the abrasive particles strike the blade edge 2 with a high velocity at a right angle or approximately at a right angle; this blade edge has only been premachined and is still more or less angular (its starting state being indicated with broken lines in FIG. 1). The center of the blasting jet direction R here runs tangentially to the center line 6 of the profile of the blade 1 on the front edge 2 of the blade and thus corresponds, at least approximately, to the later oncoming flow in operation. It is, of course, possible to shift the central longitudinal axis of the nozzle 8 and thus the center of the blasting jet 7 more toward the suction side 5 or toward the pressure side 4 as needed and/or to modify the angle of oncoming flow of the blasting jet direction R within certain limits, as illustrated in FIG. 2 on the basis of the angle β. This makes it possible to achieve asymmetrical removable of material with an emphasis on either the pressure side or the suction side, which may be appropriate under certain circumstances.

The results in terms of removal of material depend on several factors such as the pressure of the blasting jet, the outlet angle α of the blasting jet 7 from the nozzle 8, the outlet diameter D of the nozzle 8, the distance A from the edge 2 of the blade to the nozzle 8, the type of blasting means including the particle size and particle distribution in the blasting jet 7, the direction R of the blasting jet and the local duration of influence as a function of the relative rate of advance between the nozzle 8 and the part 1, the advance being parallel to the edge of the blade. These factors must be optimized as a function of the blade geometry and the blade material, which will usually require practical experiments. For example, if the distance between the blade edge 2, 3 and the nozzle 8 is too small, then instead of rounding, a concave hollowing out of the blade edge 2, 3 may occur, with maximum removal of material in the area of the stagnation point, which must be avoided at all costs. If this distance is correct, the result is a certain application of particles in the area of the stagnation point, so that this area is largely protected from removal of material and the actual removal of material for the purpose of rounding takes place downstream toward the pressure side and the suction side. According to such an experimental process optimization, however, the blasting jet results are very uniform and reproducible with a certain type of blade, so that machine operation and/or automated operation are possible.

The inventive method may be used in principle with all types of parts including in particular turbo engine blades, whether for housings, disks, rings, compressors, pumps and turbines in axial, diagonal and radial designs.

LIST OF REFERENCE NUMERALS

1 part/blade
2 edge/blade edge
3 edge/blade edge
4 surface/pressure side
5 surface/suction side
6 angle bisecting line/center line of profile
7 blasting jet
8 nozzle
A distance
D outlet diameter
R direction of beam
α outlet angle
β angle

The invention claimed is:

1. A method for rounding an edge of a part, comprising the steps of:

blasting the edge by a blast of abrasive particles, wherein the edge is formed by two adjacent surfaces of the part and wherein a center of the blast is approximately tangential to an angle bisecting line defined by the surfaces at the edge; and relatively moving the blast and the edge at a defined rate of advance along the edge to round the edge;

wherein the part is a blade of a turbo engine and wherein the edge is a prefabricated blade edge formed by a pressure side and a suction side of the blade, wherein the angle bisecting line is tangent to a center line of a profile of the blade at the blade edge, and wherein the step of relatively moving the blast and the blade edge rounds the edge toward the pressure side and/or the suction side.

2. The method according to claim 1, wherein the blast consists of abrasive particles, a carrier gas and/or a carrier liquid.

3. The method according to claim 1, wherein the abrasive particles consist of metal oxides, other ceramic compounds, salts, or organic compounds.

4. The method according to claim 1, wherein particles with a size of 0 to 500 mesh are used.

5. The method according to claim 1, wherein a pressure of the blast is adjusted to approximately 3 to 3.5 bar.

6. The method according to claim 1, further comprising at least one additional machining process.

7. The method according to claim 6, wherein the at least one additional machining process is by scouring.

8. The method according to claim 1, wherein the blade is made of alloys based on titanium (Ti), nickel (Ni) or cobalt (Co) and is a compressor blade in an axial design, and wherein the blade is manufactured by cutting and/or forging and/or electrochemical machining.

9. The method according to claim 1, wherein the blade is an individual blade, blade segment or integral blade of a disk or ring.

10. The method according to claim 1, wherein a direction of the center of the blast is set at an angle to the center line of the profile of the blade at the blade edge and/or is adjusted to be laterally offset in relation to the center line of the profile in a direction of the pressure side or the suction side of the blade.

11. The method according to claim 1, wherein the blade edge to be rounded has a surface that stands at least approximately across the adjacent pressure side and/or the suction side and has angular transitions to the pressure side and/or the suction side and the blast is angled at a right angle or approximately a right angle to a surface of the edge of the blade.

12. The method according to claim 1, wherein a direction of the center of the blast is set approximately tangential to the center line of the profile of the blade at the blade edge.

* * * * *